US006445355B2

(12) United States Patent
Kitamori et al.

(10) Patent No.: US 6,445,355 B2
(45) Date of Patent: Sep. 3, 2002

(54) NON-RADIATIVE HYBRID DIELECTRIC LINE TRANSITION AND APPARATUS INCORPORATING THE SAME

(75) Inventors: Nobumasa Kitamori, Nagaokakyo; Ikuo Takakuwa, Suita, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/751,562

(22) Filed: Dec. 28, 2000

(30) Foreign Application Priority Data

Dec. 28, 1999 (JP) ..... 11-375196

(51) Int. Cl.[7] ..... H01Q 13/10
(52) U.S. Cl. ..... 343/771; 331/117 D; 333/248
(58) Field of Search ..... 343/753, 770, 343/771, 785; 331/117 D; 333/113, 237, 239, 248, 249

(56) References Cited

U.S. PATENT DOCUMENTS 5,523,727 A * 6/1996 Shingyoji ..... 333/22 R
5,815,123 A * 9/1998 Uematsu et al. ..... 343/785
6,008,771 A * 12/1999 Tanaka et al. ..... 343/767
6,144,267 A * 11/2000 Saitoh et al. ..... 333/34
6,163,227 A * 12/2000 Saitoh et al. ..... 331/117 D
6,239,757 B1 * 5/2001 Ishikawa et al. ..... 343/711

FOREIGN PATENT DOCUMENTS

EP 0926761 A1 6/1999
JP 11195910 7/1999 ..... H01P/5/02

OTHER PUBLICATIONS

French Search Report dated Mar. 19, 2002.

* cited by examiner

*Primary Examiner*—Tho Phan
(74) *Attorney, Agent, or Firm*—Ostrolenk, Faber, Gerb & Soffen, LLP

(57) ABSTRACT

A non-radiative hybrid dielectric line transition permits a line transformation between two different types of non-radiative dielectric lines to be performed in a limited space. In addition, a non-radiative dielectric line component, an antenna apparatus, and a wireless apparatus include the above line transition. In this structure, a dielectric strip is disposed between a lower conductive plate and an upper conductive plate to form each of a hyper NRD waveguide (HNRD) and a normal NRD waveguide (NNRD). Between the two waveguides, grooves whose depths gradually become shallow from the HNRD to the NNRD are formed for receiving a third non-radiative dielectric line for performing a line transformation.

9 Claims, 13 Drawing Sheets

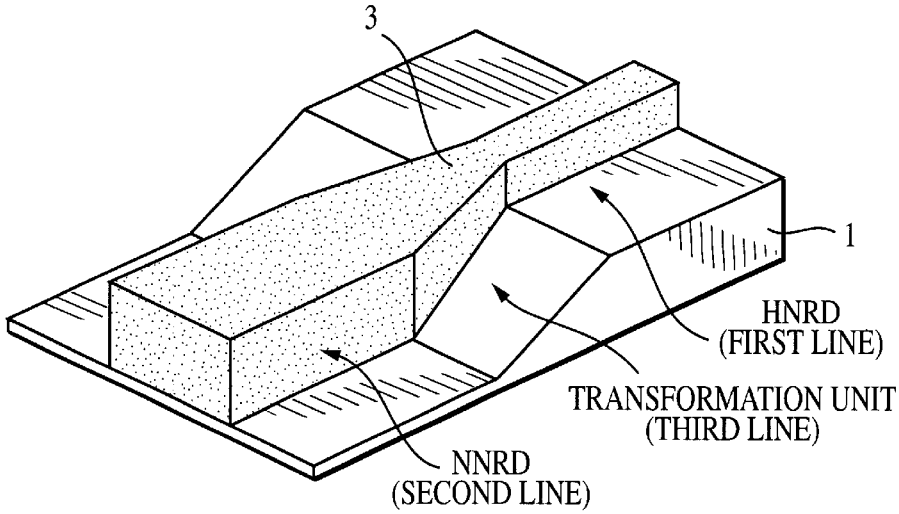
FIG. 1
FIG. 2A
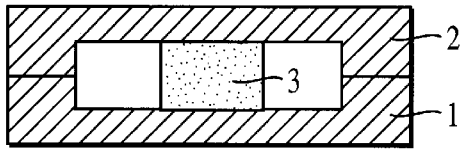
FIG. 2A'
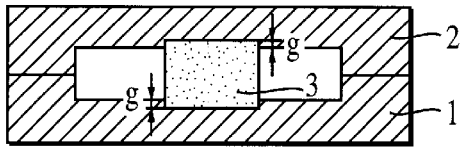
FIG. 2B
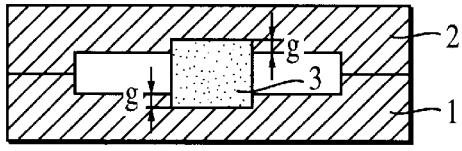
FIG. 2C
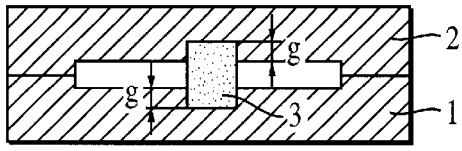

NON-RADIATIVE HYBRID DIELECTRIC LINE TRANSITION AND APPARATUS INCORPORATING THE SAME

BACKGROUND OF THE INVENTION

1. Field of the Invention

The present invention relates to a non-radiative hybrid dielectric line transition which is formed at a junction between different types of non-radiative dielectric lines. In addition, the invention relates to a component, an antenna apparatus, and a wireless apparatus incorporating the same.

2. Description of the Related Art

A dielectric line is used as a transmission line in the millimeter-wave band and the microwave band. Such a dielectric line is formed by disposing a dielectric strip between two approximately parallel conductive plates. Particularly, there is known a first type of non-radiative dielectric line (hereinafter referred to as a "normal NRD waveguide"). In the normal NRD waveguide, a distance between the conductive plates is set to be equal to or less than a half of an electromagnetic-wave propagating wavelength so that the electromagnetic wave propagates only through the dielectric strip.

However, in the normal NRD waveguide, a transmission loss occurs in a bend due to a mode transformation between an $LSM_{01}$ mode and an $LSE_{01}$ mode. As a result, a bend having an arbitrary radius of curvature cannot be designed. Thus, a second type of non-radiative dielectric line (hereinafter referred to as a "hyper NRD waveguide") has been developed. In the hyper NRD waveguide, a groove is formed in each of the opposing surfaces of the conductive plates, and the dielectric strip is disposed between the grooves to transmit an $LSM_{01}$ mode as a single mode.

Despite this advantage of the hyper NRD waveguide, if the transmission loss due to the mode transformation in the bend is not considered, the transmission loss of the normal NRD waveguide is smaller than that of the hyper NRD waveguide. The normal NRD waveguide has the further advantage that the transmission loss at a junction of two dielectric strips is less than that in the hyper NRD waveguide.

Therefore, when the normal NRD waveguide is used in a part where the characteristics of the normal NRD waveguide can be exploited and the hyper NRD waveguide is used in a part where the characteristics of the hyper NRD waveguide can be exploited, it is necessary to perform a line transition between the two types of non-radiative dielectric line. The assignee of the present invention describes a structure of a non-radiative hybrid dielectric line transition and an apparatus incorporating the same in Laid-Open Japanese Patent Application Publication No. 11-195910.

However, in a non-radiative hybrid dielectric line transition, as shown in FIG. 3 of the laid-open application, since a second transition is included, extra space is needed both in the line-width direction and line-length direction.

SUMMARY OF THE INVENTION

In view of the above-described disadvantage, the present invention provides a non-radiative hybrid dielectric line transition between the aforementioned two different types of non-radiative dielectric line, which is capable of being made smaller than the transition described in the above Japanese Patent Application Publication No. 11-195910.

The present invention further provides a non-radiative dielectric line component, an antenna apparatus, and a wireless apparatus using the non-radiative hybrid dielectric line transition.

According to a first aspect of the present invention, there is provided a non-radiative hybrid dielectric line transition including two conductive planes opposed to each other approximately in parallel, first grooves formed in opposing positions in the two conductive plates, a first non-radiative dielectric line formed by a dielectric strip disposed between the first opposing grooves, a second non-radiative dielectric line formed by a dielectric strip disposed between the two opposing conductive plates, second grooves formed between the first non-radiative dielectric line and the second non-radiative dielectric line, the depths of the second grooves are gradually changed while continuing from the first grooves, and a third non-radiative dielectric line formed by a dielectric strip disposed in the second grooves to form a non-radiative hybrid dielectric line transition connecting the first non-radiative dielectric-line and the second non-radiative dielectric line.

According to a second aspect of the present invention, there is provided a non-radiative hybrid dielectric line transition including two conductive plates forming conductive planes opposed to each other approximately in parallel, first grooves formed in opposing positions in the two conductive plates, a first non-radiative dielectric line formed by a dielectric strip disposed between the first opposing grooves, a second non-radiative dielectric line formed by a dielectric strip disposed between the two opposing conductive plates, second grooves formed between the first non-radiative dielectric line and the second non-radiative dielectric line, the depths of the second grooves being changed in a stepped form while continuing from the first grooves, and a third non-radiative dielectric line formed by a dielectric strip disposed in the second grooves to form a non-radiative hybrid dielectric line transition connecting the first non-radiative dielectric line and the second non-radiative dielectric line.

In this arrangement, in the region of the first non-radiative dielectric line formed by the dielectric strip fitted into the deep grooves, the gaps between the conductive planes of cut-off regions on both sides of the dielectric strip are narrow. In the region of the second non-radiative dielectric line, there are no grooves into which the dielectric strip is fitted, or there are shallow grooves. That is, the gaps between the conductive planes of cut-off regions on both sides of the dielectric strip are wider. As a result, between the region of the first non-radiative dielectric line and the region of the second non-radiative dielectric line, the depths of the grooves, that is, the gaps between the conductive planes of the cut-off regions on both sides of the dielectric strip change, in the region of the third non-radiative dielectric line. In other words, a line transformation between the first and second non-radiative dielectric lines is performed at the third non-radiative dielectric line.

In addition, in the above non-radiative hybrid dielectric line transition, the gaps between the conductive planes of the cut-off regions of the third non-radiative dielectric line may be set to have fixed lengths larger than the gaps of the conductive planes of the cut-off regions of the first non-radiative dielectric line. In addition, the length of the third non-radiative dielectric line in an electromagneticwave propagating direction may be set to be approximately ¼ of a line wavelength. With this arrangement, the length of the third non-radiative dielectric line serving as the line transition is reduced. Moreover, when a wave reflected at the boundary between the first and third non-radiative dielectric lines is synthesized with a wave reflected at the boundary between the third and second non-radiative dielectric lines, both of the reflected waves are canceled, and a line transformation is performed while reducing reflections and losses.

According to a third aspect of the present invention, there is provided a non-radiative dielectric line component including the first and second non-radiative dielectric lines described above, with the non-radiative hybrid dielectric line transition disposed at a junction between the first and second non-radiative dielectric lines. For example, in a single module formed by combining a plurality of millimeter-wave circuit components, a junction of lines between the components is formed by the second non-radiative dielectric line, and bends in the components are formed by the first non-radiative dielectric line. In addition, the non-radiative hybrid dielectric line transition is disposed between the first and second non-radiative dielectric lines. As a result, for example, with the use of a hyper NRD waveguide as the first non-radiative dielectric line and a normal NRD waveguide as the second non-radiative dielectric line, the non-radiative dielectric line component of the invention has an overall compact size and reduced transmission loss while exploiting the characteristics of both waveguides.

In addition, in the above non-radiative dielectric line component, two of the second non-radiative dielectric lines may be arranged at a predetermined distance to form a directional coupler, and the first non-radiative dielectric lines may be connected to ends of the two second non-radiative dielectric lines via the third non-radiative dielectric lines. The electric-field energy in the second non-radiative dielectric line distributes more widely than that in the first non-radiative dielectric line. Thus, the above arrangement provides an increased coupling strength between the two second non-radiative dielectric lines forming the directional coupler. Moreover, with the increased coupling strength, since the length of the coupling part between the second non-radiative dielectric lines can be reduced, the overall component can be miniaturized.

According to a fourth aspect of the present invention, there is provided an antenna apparatus including the directional coupler described above. In this antenna apparatus, the directional coupler is divided into a mobile section and a fixed section along an electromagnetic-wave propagating direction at a part where the two second non-radiative dielectric lines forming the directional coupler are coupled to each other. The fixed section includes a dielectric lens, and the mobile section includes a primary radiator. The primary radiator receives a signal transmitted via the directional coupler and radiates the signal via the dielectric lens and sends a signal received from the dielectric lens to the directional coupler.

In this apparatus, the mobile section can be displaced with respect to the fixed section in order to displace the directivity of a beam, while the fixed-section circuit is coupled to the primary radiator via the directional coupler.

According to a fifth aspect of the present invention, there is provided a wireless apparatus including the above non-radiative dielectric line component or the above antenna apparatus to form a millimeter-wave communication apparatus, a millimeter-wave radar, or the like.

Other features and advantages of the present invention will become apparent from the following description of the invention which refers to the accompanying drawings, in which like references denote like elements and parts.

BRIEF DESCRIPTION OF THE DRAWINGS

FIG. 1 is a partial perspective view of a non-radiative hybrid dielectric line transition according to a first embodiment of the present invention;

FIGS. 2A, 2A', 2B and 2C show sectional views of the non-radiative hybrid dielectric line transition including the adjacent parts;

DESCRIPTION OF EMBODIMENTS OF THE INVENTION

Figure 3A:
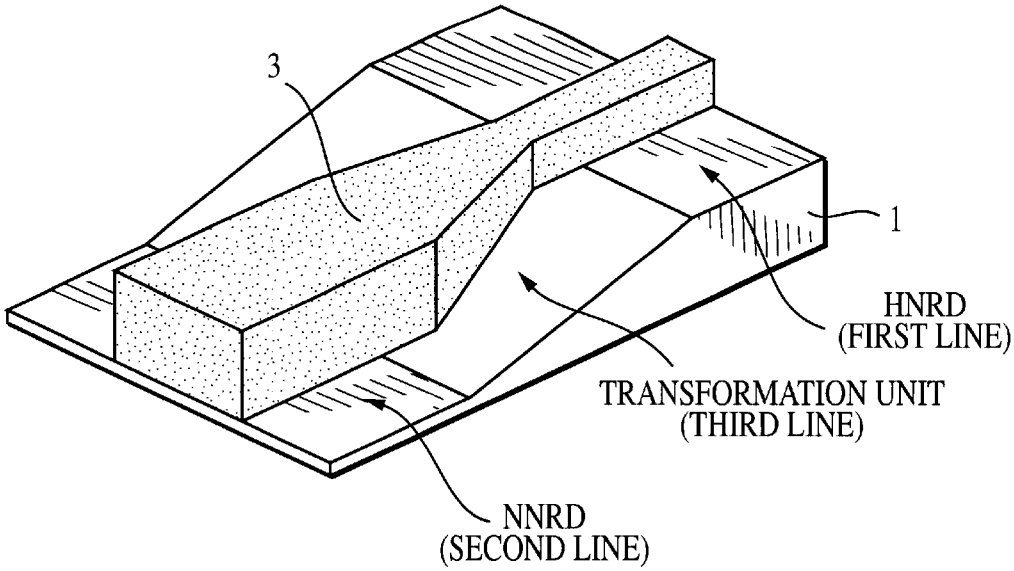
FIGS. 3A and 3B show partial perspective views of two examples of a non-radiative hybrid dielectric line transition according to a second embodiment of the present invention.

Referring to FIGS. 1 and 2, a description will be given of a non-radiative hybrid dielectric line transition according to a first embodiment of the present invention.

FIG. 1 shows a perspective view of the transformation unit structure, in which an upper conductive plate is removed. FIGS. 2A, 2A', 2B and 2C show sectional views of the non-radiative dielectric lines. The upper conductive plate 2 has a configuration which is a mirror image of the lower conductive plate 1 shown in FIG. 1. The upper and lower conductive plates 1 and 2 form opposing parallel conductive planes. A dielectric strip 3 is arranged between the two conductive plates 1 and 2. In FIG. 1, a normal NRD waveguide is abbreviated by NNRD, and a hyper NRD waveguide is abbreviated by HNRD.

The sectional views of the NNRD and HNRD waveguides are shown respectively in FIGS. 2A and 2C. In other words, in the normal NRD waveguide, the gap between the conductive planes formed by the conductive plates 1 and 2 is set to be approximately equal to the height of the dielectric strip 3 as shown in FIG. 2A. Then, a region through which an $LSM_{01}$-mode electromagnetic wave and an $LSE_{01}$-mode electromagnetic wave propagate is formed by the dielectric strip 3. In addition, a wave cut-off region is formed in a space between the conductive planes of the upper and lower conductive plates 1 and 2 on both sides of the dielectric strip 3.

Furthermore, as shown in FIG. 2C, in the region of the hyper NRD waveguide, opposing grooves are formed in the conductive plates 1 and 2 and the dielectric strip 3 is fitted into the grooves. With this arrangement, the gaps between the conductive planes formed by the upper and lower conductive plates on both sides of the dielectric strip 3 are narrowed to form a propagating region through which an $LSM_{01}$-mode wave as a single mode propagates in the dielectric strip 3, while a wave cut-off region is formed in a space on each side of the dielectric strip 3.

In both the normal NRD waveguide and the hyper NRD waveguide, the height of the dielectric strip, which is equivalent to the dimension of the gap between the conductive planes of the conductive plates adjacent the dielectric strip 3, is unchanged. However, the width of the strip measured in a direction parallel to the conductive planes is made wider in the region of the normal NRD waveguide while the width thereof is made narrower in the region of the hyper NRD waveguide. With this arrangement, the size of the dielectric strip 3 is determined so as to obtain the most appropriate electrical characteristics in the frequency band to be used. Furthermore, the depth of each groove g of the hyper NRD waveguide is set in such a manner that the cut-off frequency of the $LSM_{01}$-mode is lower than the cut-off frequency of the $LSE_{01}$-mode according to the heights of the gaps between the conductive planes on both sides of the dielectric strip.

In FIG. 1 and FIGS. 2A to 2C, a line transition region (transformation unit) is equivalent to a third non-radiative dielectric line between the hyper NRD waveguide HNRD as a first non-radiative dielectric line and the normal NRD waveguide NNRD as a second non-radiative dielectric line. In this region, a line transformation between the hyper NRD waveguide and the normal NRD waveguide is performed. In the line transition region, the depth of the groove g formed in each conductive plate is gradually made shallower from the HNRD waveguide to the NNRD waveguide, and the gaps between the conductive planes of the conductive plates on both sides of the dielectric strip 3 become gradually wider, forming a tapered space. In addition, the width of the dielectric strip 3 is also gradually broadened to form a tapered structure from the HNRD waveguide to the NNRD waveguide.

With the above structure, there are small changes in line impedances at a boundary between the HNRD waveguide and the line transition region and at a boundary between the transformation unit and the NNRD waveguide, and reflections on the boundaries can be suppressed. Therefore, a transmission loss due to the line transformation can be suppressed.

In order to fix the dielectric strip 3 of the NNRD waveguide onto the conductive plates 1 and 2, as shown in FIG. 2A' relatively shallow grooves g may be formed inside the conductive plates 1 and 2 in the transformation unit and the dielectric strip 3 is fitted into the grooves g.

Figure 3B:
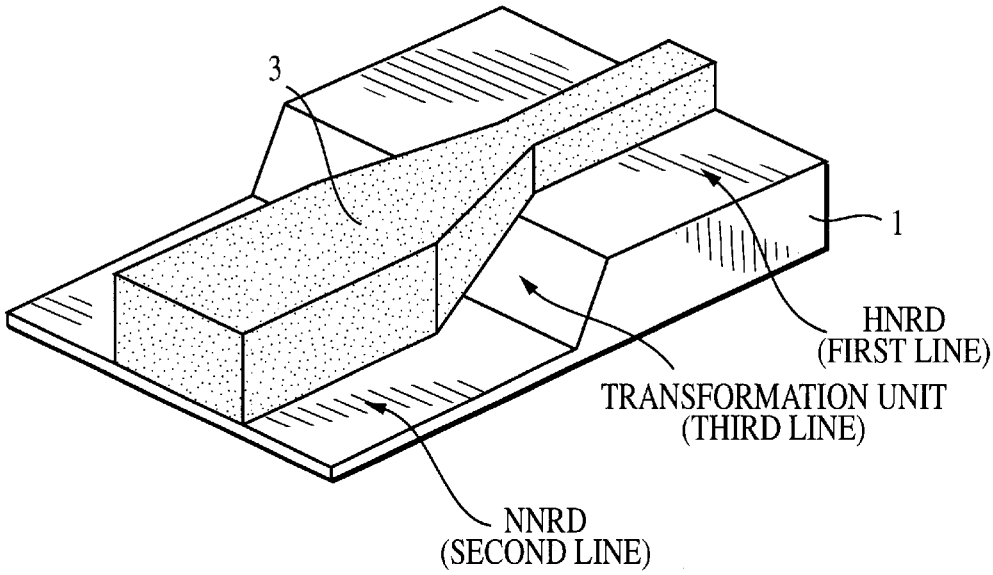

FIGS. 3A and 3B show two examples of a non-radiative hybrid dielectric line transition according to a second embodiment of the present invention. Both FIGS. 3A and 3B show perspective views of the structure, in which the upper conductive plates are removed. Each of the upper conductive plates has a configuration which is a mirror image of the lower conductive plate 1. A dielectric strip 3 is fitted into grooves formed in the upper and lower conductive plates to form a HNRD waveguide, a NNRD waveguide, and a line transition therebetween. In the example shown in FIG. 1, the range of the line transition in which the depths of the grooves of the conductive plates 1 and 2 gradually change coincides with the range in which the width of the dielectric strip 3 gradually changes. However, as shown in FIG. 3A, alternatively, the depths of the grooves of the conductive plates may be changed in a range longer than the range in which the width direction of the dielectric strip 3 is tapered. In contrast, as shown in FIG. 3B, the depths of the grooves of the conductive plates may be changed in a range shorter than the range in which the width direction of the dielectric strip 3 is tapered.

Next, referring to FIG. 4, a description will be given of an example of a non-radiative hybrid dielectric line transition according to a third embodiment of the present invention.

Figure 4:
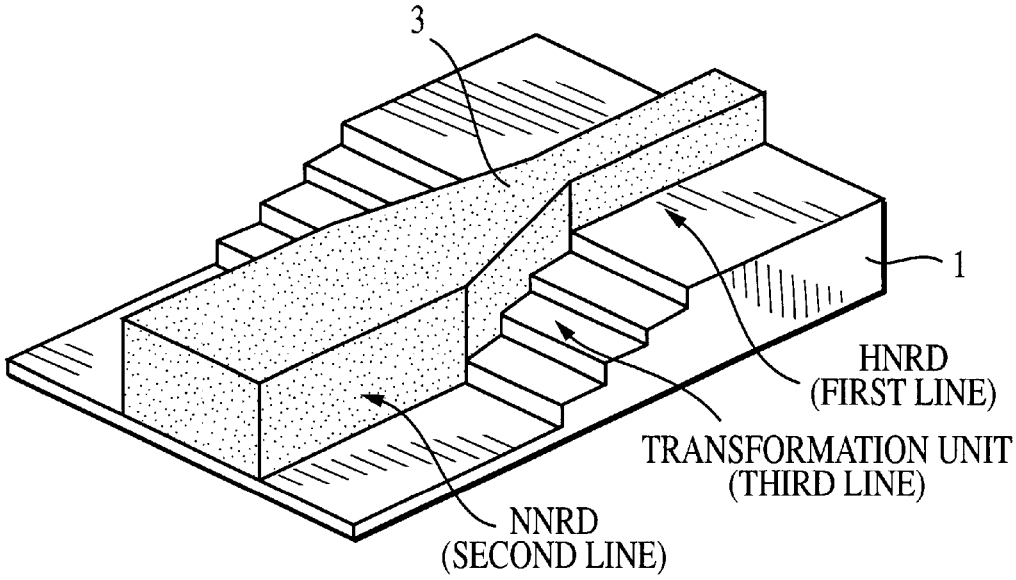
FIG. 4 is a partial perspective view of a non-radiative hybrid dielectric line transition according to a third embodiment of the present invention.

FIG. 4 is a perspective view of the line transition, in which an upper conductive plate is removed. The upper conductive plate has a configuration which is a mirror image of the lower conductive plate 1 shown in FIG. 4. When compared with the example shown in FIG. 1, it is clear that the depths of the grooves in the upper and lower conductive plates are changed in steps in the region of a line transition formed between a HNRD waveguide and a NNRD waveguide. In other words, the gaps between the upper and lower conductive plates on both sides of the dielectric strip 3 are broadened in a stepped form in a direction from the HNRD waveguide to the NNRD waveguide.

With the above arrangement, since the line impedance changes step by step, signal reflections caused by line discontinuities can be suppressed. As a result, a transmission loss at the line transition can also be suppressed.

Figure 5A:
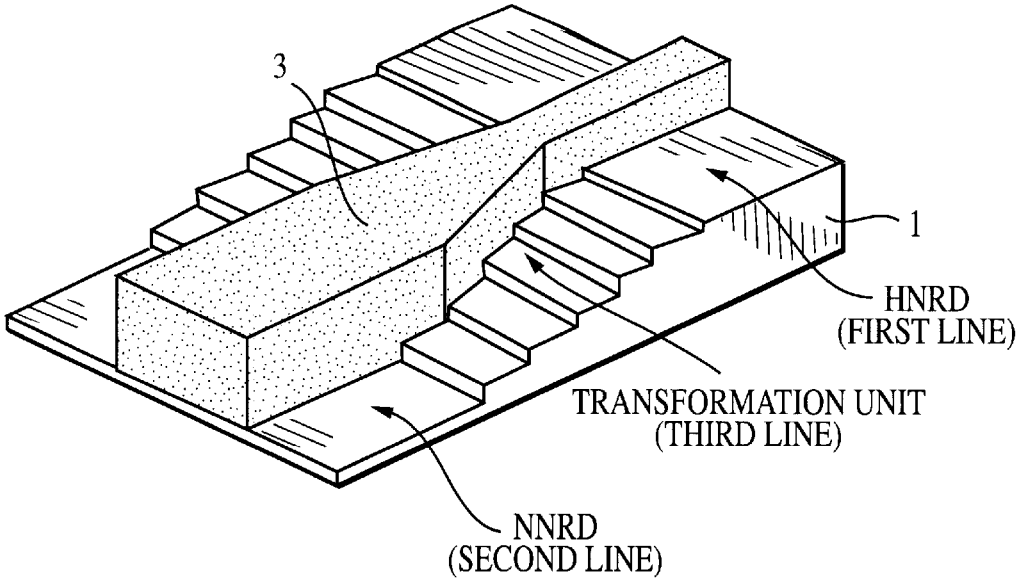
FIGS. 5A and 5B show partial perspective views of a non-radiative hybrid dielectric line transition according to a fourth embodiment of the present invention.
Figure 5B:
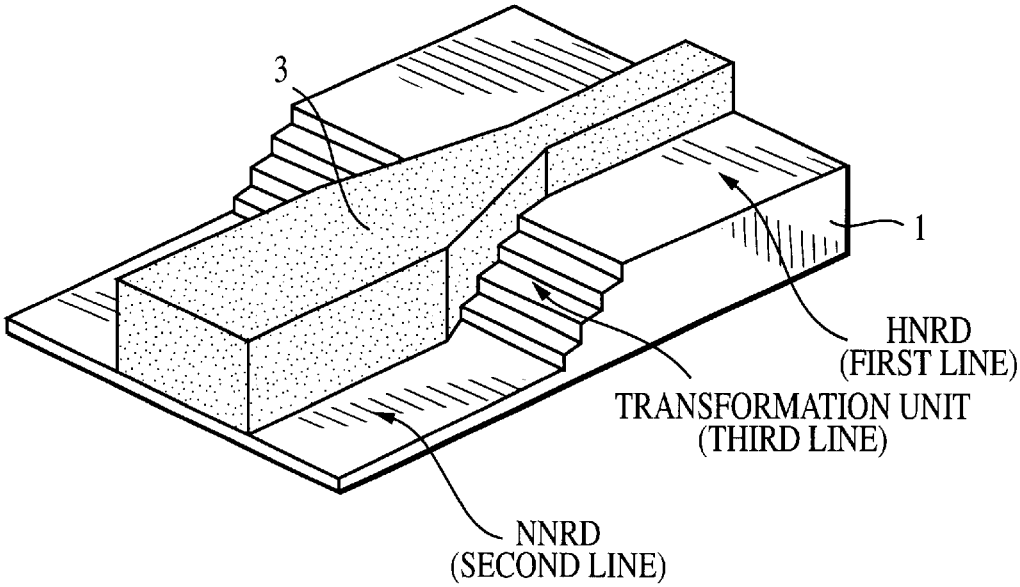

FIGS. 5A and 5B show other two examples of a non-radiative hybrid dielectric line transition according to a fourth embodiment of the present invention. Each of FIGS. 5A and 5B shows a perspective view of the line transition, in which an upper conductive plate is removed. The upper conductive plate has a configuration which is a mirror image of the lower conductive plate 1 shown in each of the figures. In the example shown in FIG. 4, the range of the line transition in which the depths of the grooves formed in the conductive plates 1 and 2 change step by step coincides with the range in which the width of the dielectric strip 3 is tapered. However, as shown in FIG. 5A, the depths of the grooves can be changed in steps in a range longer than the range in which the width of the dielectric strip 3 changes in the tapered form. In contrast, as shown in FIG. 5B, the depths of the grooves can be changed in the stepped form in a range shorter than the range in which the width of the dielectric strip 3 changes in the tapered form.

Next, referring to FIGS. 6 and 7, a description will be given of a non-radiative hybrid dielectric line transition according to a fifth embodiment of the present invention.

Figure 6:
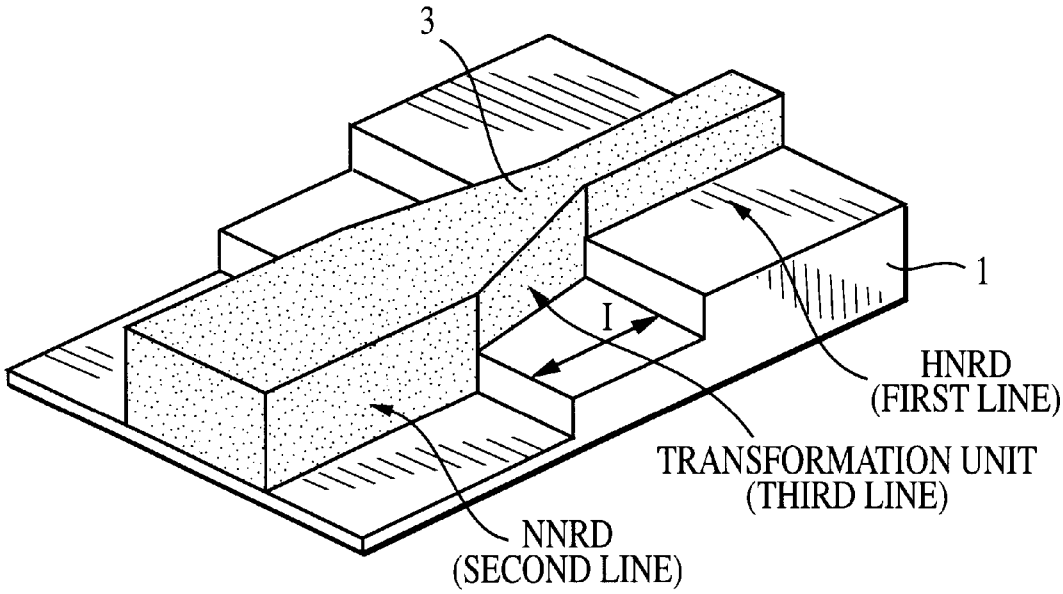
FIG. 6 is a partial perspective view of a non-radiative hybrid dielectric line transition according to a fifth embodiment of the present invention.
Figure 7:
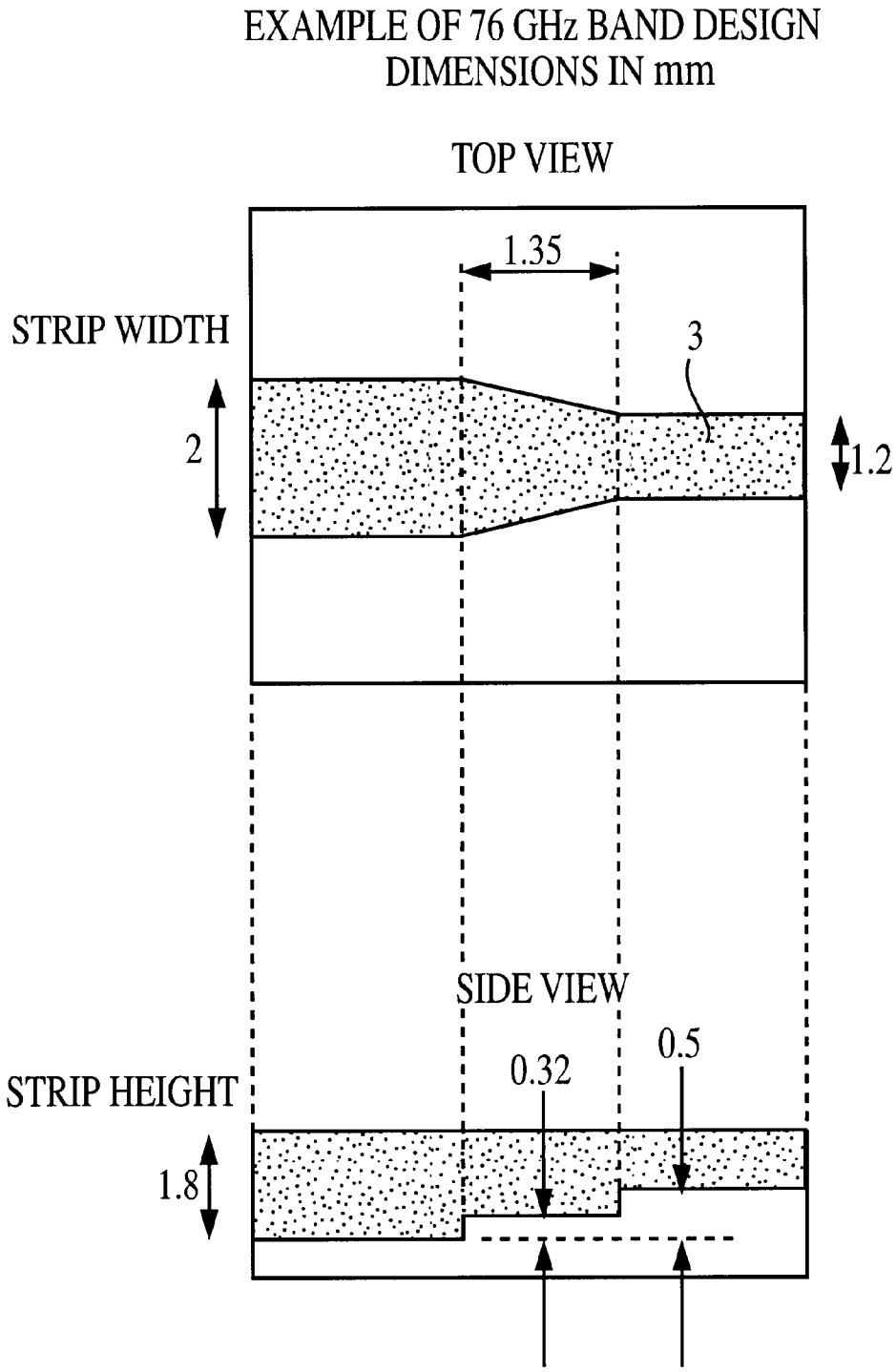
FIG. 7 is a top view and a side view of the non-radiative hybrid dielectric line transition according to the fifth embodiment.

FIG. 6 shows a perspective view of the line transition, in which an upper conductive plate is removed. FIG. 7 shows a top view and a side view of the structure in the same situation. In this embodiment, the line length of a line transition between a HNRD waveguide and a NNRD waveguide is indicated by reference character L. Over the line length L, there are formed grooves shallower than grooves of the HNRD waveguide so that the depths of the grooves are changed entirely in a single step. Furthermore, when the line wavelength is equivalent to λg, the line length L of the line transition is set to be approximately λg/4. For example, when used in the band of 76 GHz, as shown in FIG. 7, the relative permittivity of the dielectric strip 3 is set to be 2.04, the height thereof is set to be 1.8 mm, the width of the HNRD waveguide is set to be 1.2 mm, the width of the NNRD waveguide is set to be 2.0 mm, and the length L of the line transition is set to be 1.35 mm. In this condition, the width of a dielectric strip 3 is changed in a tapered form at the line transition. The depths of grooves of the HNRD waveguide are set to be 0.5 mm, and the depths of grooves of the line transition are set to be 0.32 mm. As a result, the gaps between conductive planes on both sides of the dielectric strip 3 of the HNRD waveguide are set to be 0.8 mm (1.8−2×0.5), and the gaps between conductive planes on both sides of the dielectric strip 3 of the line transition are set to be 1.16 mm (1.8−0.32 ×2). In this way, by setting the line length L of the line transition to be λg/4, a wave reflected at the boundary between the HNRD waveguide and the line transition is synthesized with a wave reflected at the boundary between the NNRD waveguide and the line transition, by which the two reflected waves reflecting toward the HNRD waveguide and the NNRD waveguide are cancelled. Thus, reflection characteristics can be reduced by optimally setting the depths of the grooves of the line transition so that the strengths of the two reflected waves can be approximately equal.

Next, referring to FIG. 8 to FIG. 10, a description will be given of a non-radiative hybrid dielectric line transition according to a sixth embodiment of the present invention.

Figure 8:
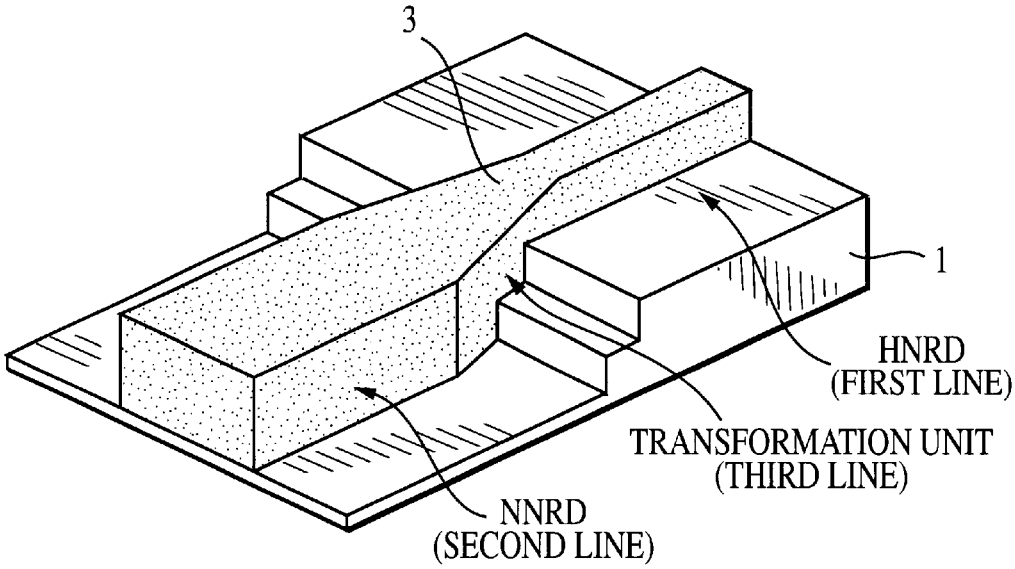
FIG. 8 is a partial perspective view of a non-radiative hybrid dielectric line transition according to a sixth embodiment of the present invention.

FIG. 8 shows a perspective view of the line transition, in which an upper conductive plate is removed. FIGS. 9 and 10 show top views and side views indicating the dimensions of sections in the cases of two different applied frequency bands. In this embodiment, the grooves of the line transition are shallower than the grooves of the HNRD waveguide and the depths of the grooves are changed in a stepped form. Also, the width of a dielectric strip 3 is changed in a tapered form along the line length direction in a range longer than the range in which the depths of the grooves are changed in the stepped form.

Figure 9:
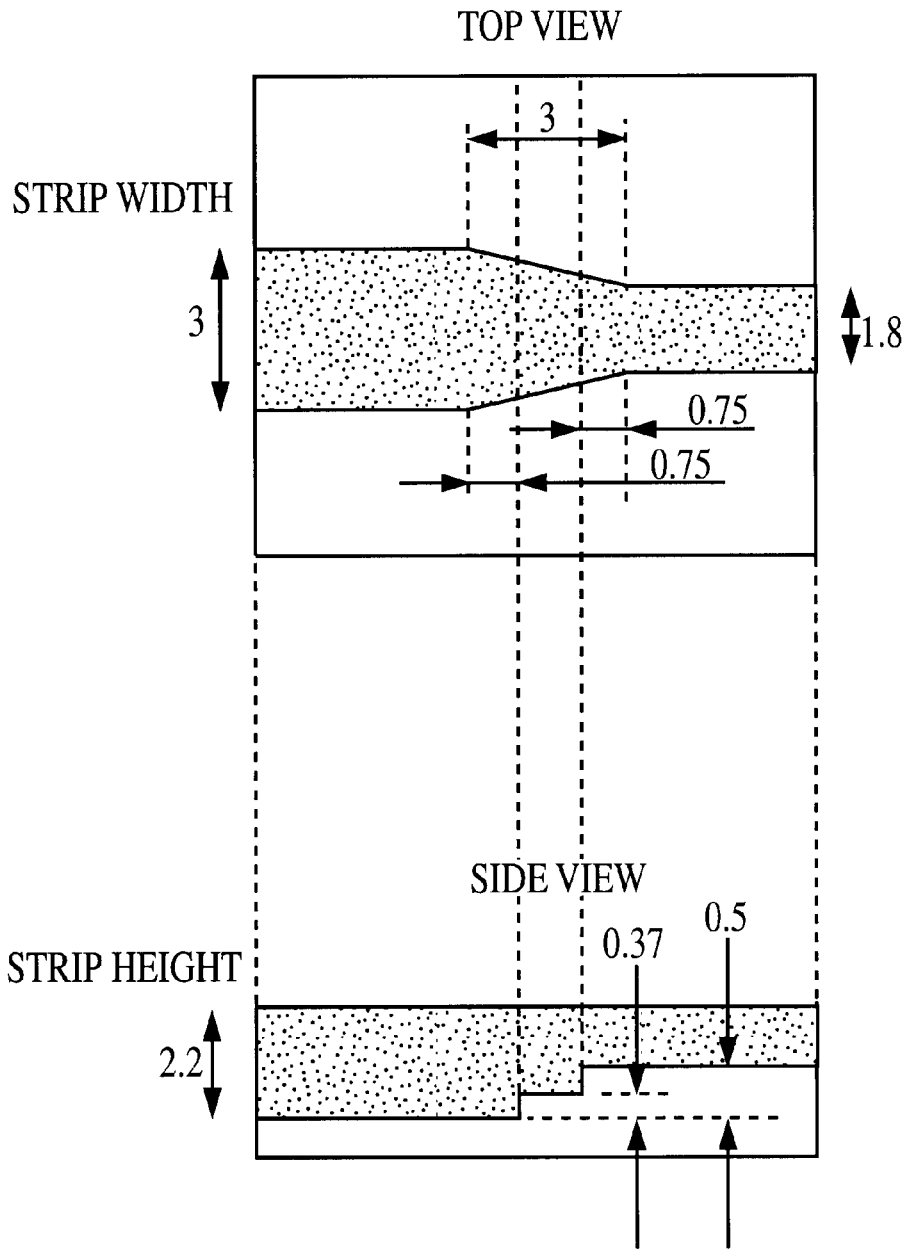
FIG. 9 is a top view and a side view of the non-radiative hybrid dielectric line transition according to the sixth embodiment.
Figure 10:
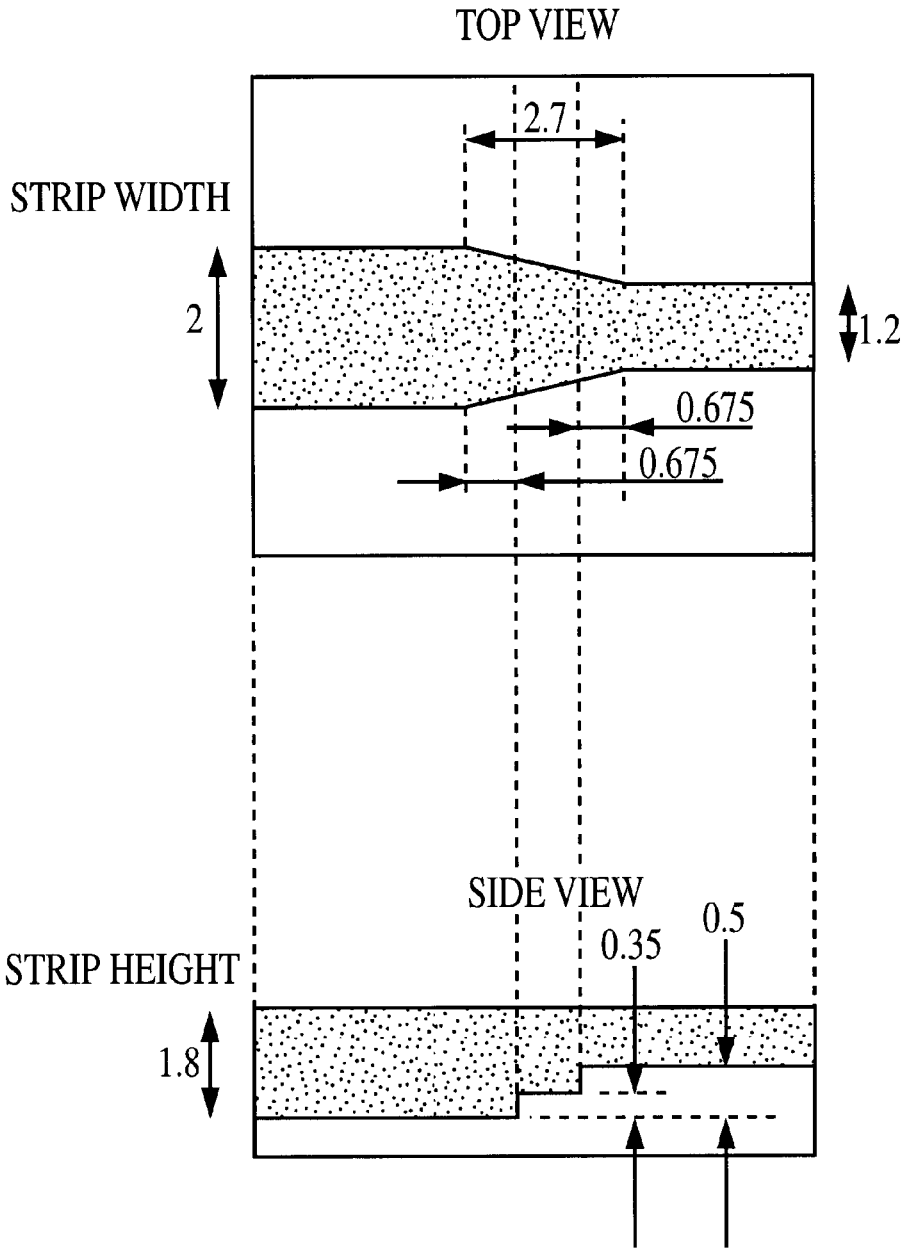
FIG. 10 is a top view and a side view of another non-radiative hybrid dielectric line transition according to the sixth embodiment.

FIG. 9 shows the dimensions of sections applied in the 60 GHz band, and FIG. 10 shows the dimensions of sections applied in the 76 GHz band. In this situation, when the length of the range in which the depths of the grooves are changed in the stepped form is set to be approximately λg/4, reflected waves can be cancelled by synthesizing waves reflected at the parts where the depths of the grooves are changed. As a result, lowered reflection characteristics can be obtained.

Figure 11:
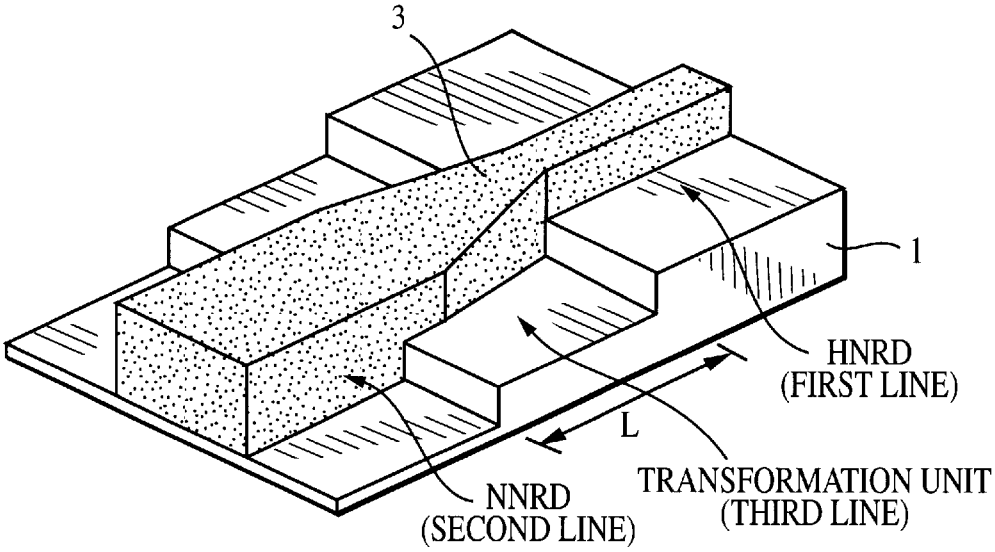
FIG. 11 is a partial perspective view of a non-radiative hybrid dielectric line transition according to a seventh embodiment of the present invention.

FIG. 11 shows a non-radiative hybrid dielectric line transition according to a seventh embodiment of the present invention. This figure shows a perspective view of the line transition, in which an upper conductive plate is removed. In this example, the depths of grooves are changed in a stepped form by making the grooves of the line transition shallower than the grooves of the HNRD waveguide. In contrast with the cases shown in FIGS. 6 and 8, the width of a dielectric strip 3 is changed in a tapered form in a range shorter than the range in which the depths of the grooves are changed in the stepped form. In this example, the range where the dielectric strip 3 is tapered coincides at one end with the interface between the line transition and the HNRD waveguide. However, it could instead coincide with the interface between the line transition and the NNRD waveguide, or with neither interface as shown in FIG. 5A.

If the line impedance of the HNRD waveguide is indicated by Z1 and the line impedance of the NNRD waveguide is indicated by Z2, the depths of the grooves of the line transition are set in such a manner that the line impedance of the line transition serving as a third non-radiative dielectric line is equivalent to $\sqrt{Z1 \times Z2}$. With this arrangement, impedance matching between the HNRD waveguide and the NNRD waveguide can be obtained.

Figure 12:
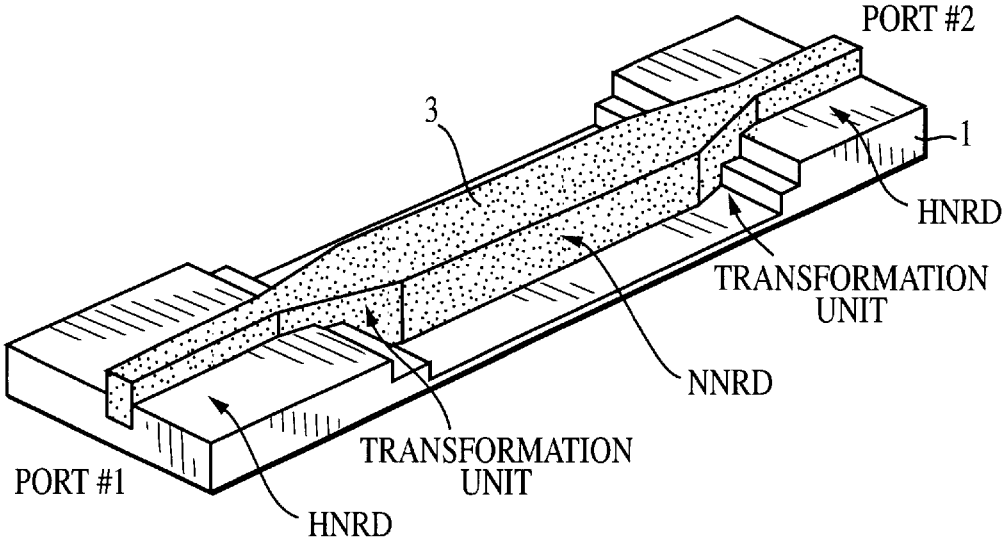
FIG. 12 is a partial perspective view of a non-radiative dielectric line component, which is used for evaluation, according to an eighth embodiment of the present invention.
Figure 13:
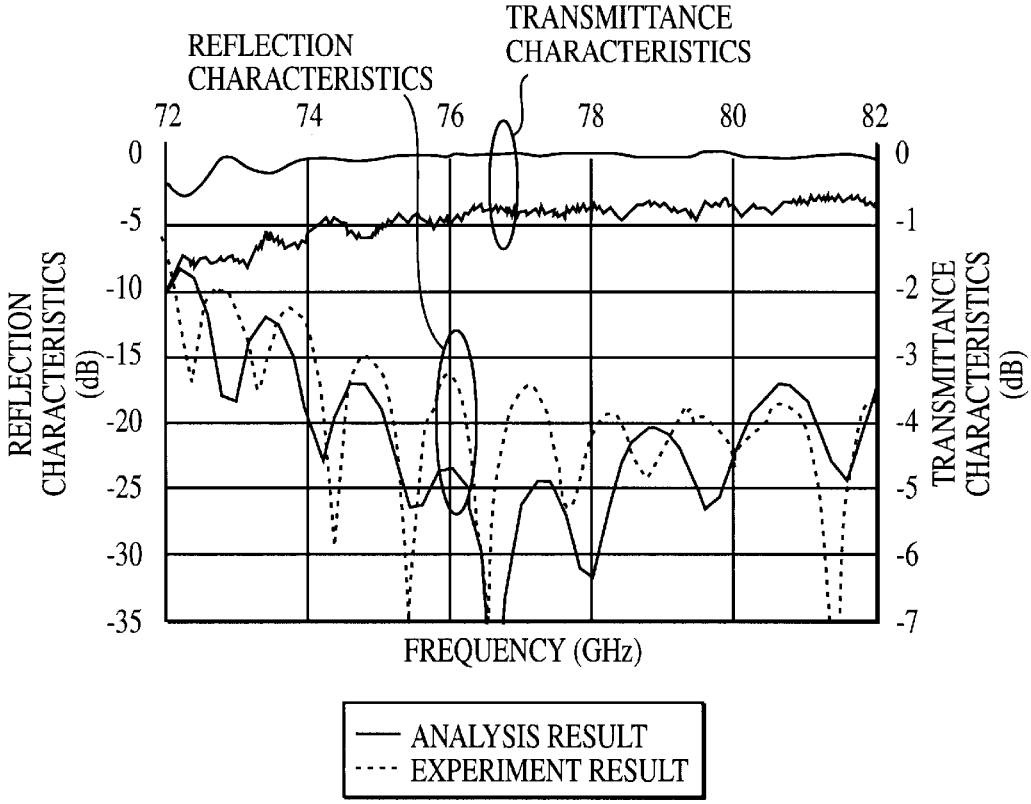
FIG. 13 is a graph showing the characteristics of the above component according to the eighth embodiment.

Next, FIG. 12 shows an evaluation circuit using a non-radiative hybrid dielectric line transition according to an eighth embodiment of the present invention and FIG. 13 is a graph showing an example of the characteristics of the circuit.

FIG. 12 shows a perspective view of the circuit, in which an upper conductive plate is removed. The upper conductive plate has a configuration which is a mirror image of a lower conductive plate 1. These conductive plates are arranged in such a manner that a dielectric strip 3 is fitted into the grooves in the upper and lower conductive plates. The circuit structure including line transitions and dielectric lines sandwiching the line transitions is the same as the structure shown in FIG. 8. In this circuit, from a port #1 to a port #2, an electromagnetic wave sequentially propagates through a first HNRD waveguide, a first line transition, a NNRD waveguide, a second transformation unit, and a second HNRD waveguide.

FIG. 13 shows transmittance characteristics from the port #1 to the port #2 in the evaluation circuit and reflection characteristics from the port #1to the port #2. In this case, a solid line indicates an analysis result obtained by a calculation (simulation), and a broken line indicates a result obtained by an actual measurement. However, the analysis result does not include the transmission losses of the lines. In this way, it is found that low reflection/low insertion loss characteristics can be obtained by using the line transition shown in FIG. 8.

Next, as an example of a non-radiative dielectric line component according to a ninth embodiment of the present invention, a directional coupler will be illustrated with reference to FIG. 14.

Figure 14:
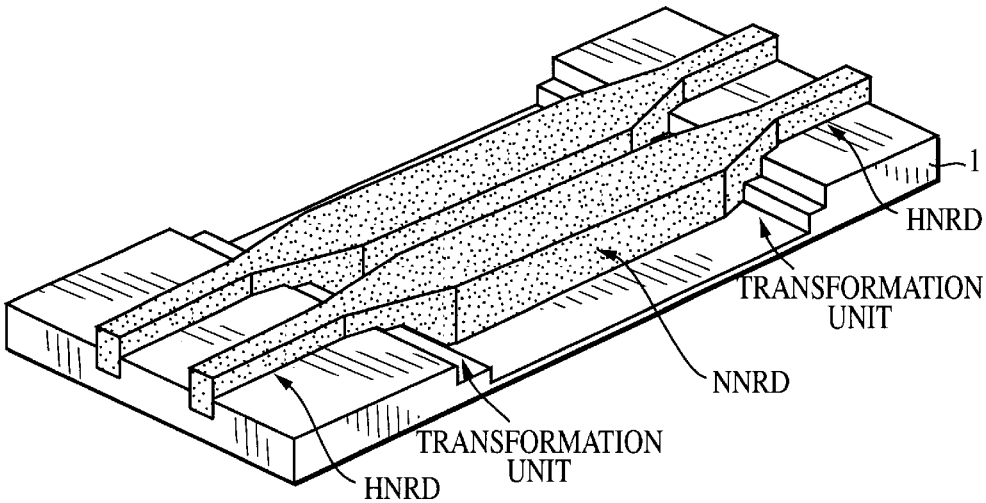
FIG. 14 is a partial perspective view of the structure of a directional coupler according to a ninth embodiment.

FIG. 14 shows a perspective view of the directional coupler, in which an upper conductive plate is removed. The upper conductive plate is arranged as a mirror image of the lower conductive plate 1. In the directional coupler, as shown in FIG. 12, there is provided a pair of lines. Each of the lines has HNRD waveguides used as input/output ports and an NNRD waveguide disposed between two line transitions. In this way, by arranging the NNRD waveguides in parallel to each other at a predetermined distance, electromagnetic-field coupling is obtained between the lines. The coupling strength between the HNRD waveguides is higher than the coupling strength between the NNRD waveguides. In addition, the gap between the dielectric strips of both pairs of HNRD waveguides is wider than the gap between the dielectric strips of the NNRD waveguides. As a result, the coupling strength between the HNRD waveguides is increased. Thus, a branching ratio of the directional coupler is determined by the lengths of the NNRD waveguides.

As described above, the HNRD waveguides are used as the input/output ports of the directional coupler. Thus, even if a bend is arbitrarily arranged at each of the input and output portions of the directional coupler, there is no loss due to a mode transformation occurring at the bend. Furthermore, since the coupling strength between the NNRD waveguides is high, the non-radiative dielectric line component can be formed even when a dimensional accuracy necessary for the gaps between the two dielectric strips is reduced. Moreover, even with the NNRD waveguides having short lengths, a predetermined coupling strength can be obtained. Thus, the overall component can be miniaturized.

Next, the structure of an antenna apparatus according to a tenth embodiment of the present invention will be illustrated with reference to FIGS. 15 and 16.

Figure 15:
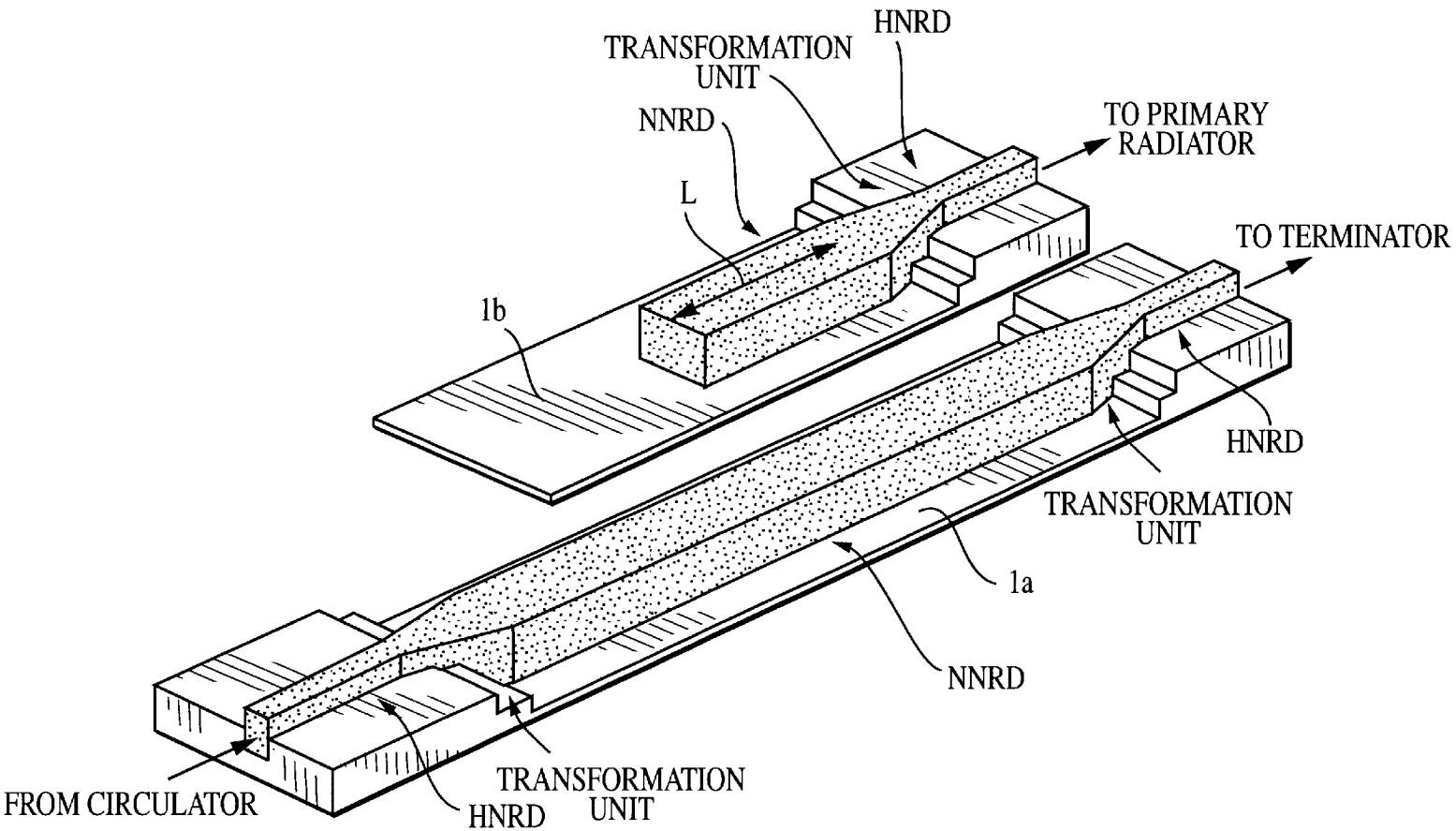
FIG. 15 is a perspective view of a directional coupler in an antenna apparatus according to a tenth embodiment of the present invention.

FIG. 15 shows a perspective view of a directional coupler formed between a mobile section and a fixed section disposed in an antenna apparatus. Similarly, in this figure, an upper conductive plate is removed. The upper conductive plate will be arranged as a mirror image of the lower conductive plate. A line formed on a conductive plate 1*a* is the fixed section, and a line formed on a conductive plate 1*b* is the mobile section. The part on the conductive plate la where a line transformation is performed sequentially from a HNRD waveguide, a first line transition, and a NNRD waveguide, to a second line transition and a second HNRD waveguide, is equivalent to one-half of the directional coupler shown in FIG. 14. On the mobile section, a line transition is disposed between a HNRD waveguide and a NNRD waveguide. The NNRD waveguides on both the mobile section and the fixed section are arranged closely in parallel to each other at a predetermined distance. Electromagnetic-field coupling is obtained between the two NNRD waveguides to form the directional coupler. The coupling length L of the directional coupler is equivalent to the length of the NNRD waveguide on the mobile section. Thus, by appropriately setting the length L, the coupling amount of the directional coupler is set to be 0 dB, and power is supplied from a circulator (see FIG. 17) to a primary radiator (see FIG. 16) while maintaining a low transmission loss. In addition, a signal received from the primary radiator is transmitted to the circulator while maintaining a low transmission loss.

Figure 16:
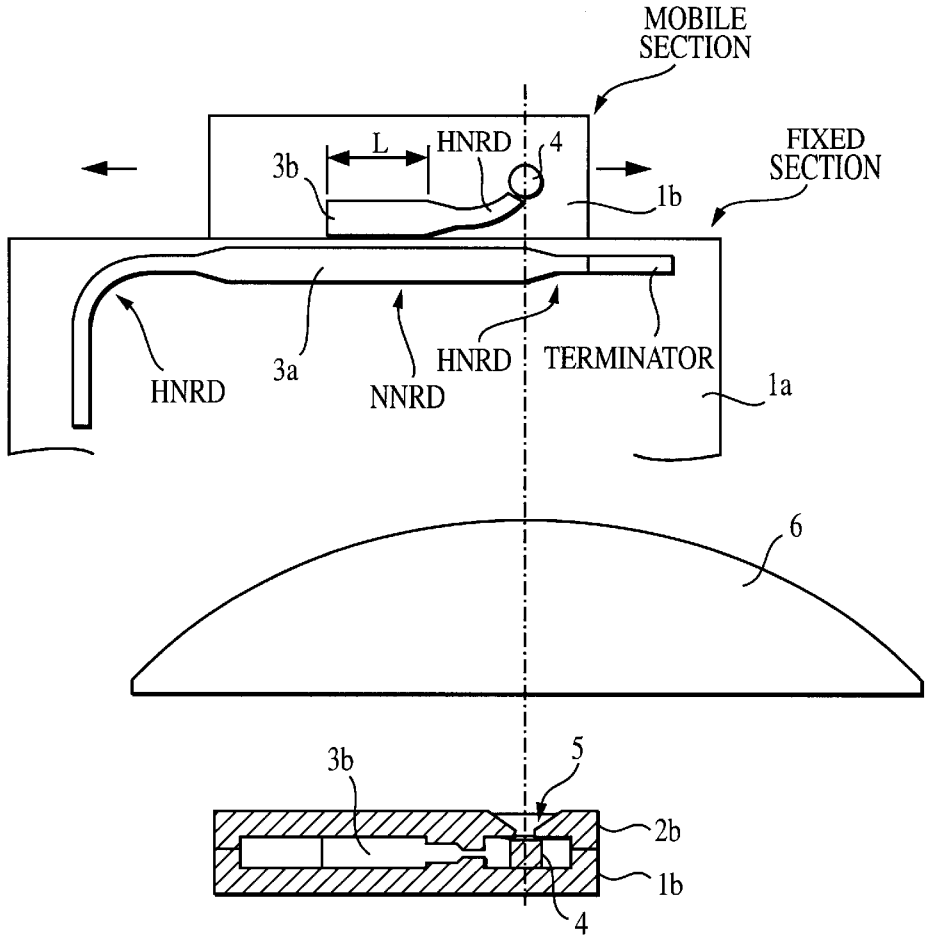
FIG. 16 is a top view and a sectional view of the above antenna apparatus.

FIG. 16 shows a structure including the directional coupler shown in FIG. 15 and the primary radiator connected thereto and the relationship between the parts and a dielectric lens. In FIG. 16, the upper part is a top view of the structure, in which an upper conductive plate is removed. The lower part shows a sectional view of the mobile section and the relationship between the mobile section and the dielectric lens. A terminator is connected to one of the HNRD waveguides on the fixed section. A bend is formed in the other HNRD waveguide to connect to the circulator. A primary radiator 4 formed of a dielectric resonator is disposed at an end of the HNRD waveguide of the mobile section. As shown in the sectional view of FIG. 16, an opening 5 is disposed at the part of the primary radiator 4 adjacent to the dielectric lens 6. The primary radiator 4 is electromagnetically coupled with an $LSM_{01}$-mode propagating through a dielectric strip 3*b*, and resonates in an $HE_{111}$-mode having an electric-field component in the same direction as the electric-field direction of the dielectric strip 3*b*. Then, an electromagnetic wave with linear polarization is radiated in a direction perpendicular to a conductive plate 2*b* via the opening 5. The radiated wave, which is converged by the dielectric lens 6, forms a given beam. In contrast, when a received electromagnetic wave converged by the dielectric lens 6 is input via the opening 5, the primary radiator 4 is excited in the $HE_{111}$-mode, by which an electromagnetic wave of the $LSM_{01}$-mode propagates through the dielectric strip 3*b* coupled to the primary radiator 4 and is transmitted to the circulator via the directional coupler.

With the above arrangement, there is also provided an actuator for allowing the mobile section to be displaced with respect to the fixed section. When the mobile section is displaced in the directions of the arrows shown in FIG. 16, the primary radiator 4 is moved within a substantial focal surface of the dielectric lens 6. As a result, the directivities of a transmitted wave beam and a received wave beam can be scanned.

Figure 17:
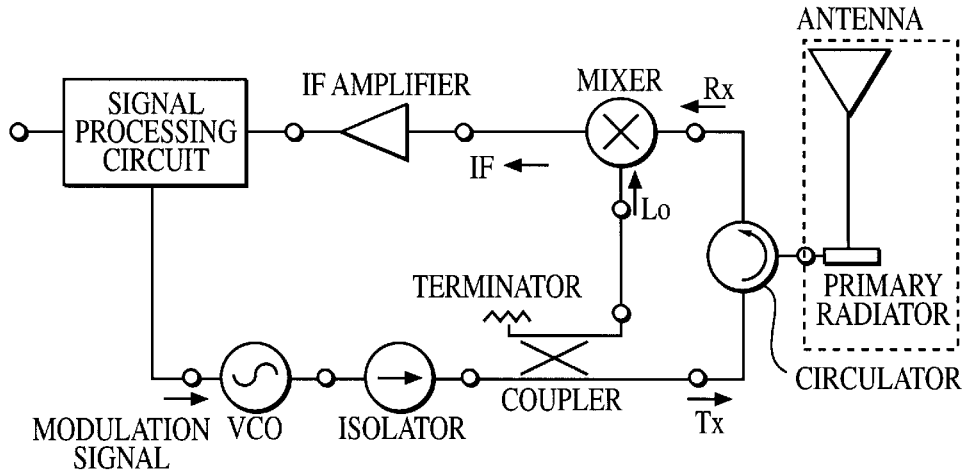
FIG. 17 is a block diagram of a millimeter-wave radar module according to an eleventh embodiment of the present invention.

FIG. 17 is a block diagram showing the structure of a millimeter-wave radar module according to an eleventh embodiment of the present invention. In this case, VCO is a voltage-controlled oscillator having an element such as a Gunn diode wherein the oscillation frequency is modulated by a modulation signal from a signal processing circuit. A NRD waveguide is formed in such a manner that an oscillating signal Tx propagates through a path from an isolator, a coupler, and a circulator to a primary radiator in sequence. In this situation, a directional coupler disposed between a fixed section and a mobile section of the primary radiator has the structure shown in each of FIGS. 15 and 16. A signal Rx received from the primary radiator is transmitted to a mixer via the circulator. The mixer mixes a local signal Lo sent from the coupler and the received signal Rx to generate an intermediate frequency signal IF. A signal processing circuit detects a distance to a detected object and a relative velocity based on the relationship between the intermediate frequency signal amplified by an IF amplifier and the modulation signal of the VCO and outputs that information to a host apparatus.

In addition to the example shown in FIG. 17, the present invention can be applied to a millimeter-wave communication apparatus in which a millimeter-wave signal is transmitted via a non-radiative dielectric line and the like.

In each of the above embodiments, the two parallel conductive planes are formed by disposing the upper and lower conductive plates in the opposing manner. These conductive plates may be metal plates. Alternatively, the plates used in the present invention may be formed by disposing conductive films on surfaces of dielectric plates or insulating plates.

As described above, according to the first and second aspects of the present invention, in the region of the third non-radiative dielectric line serving as the line transition, the depths of the grooves which receive the dielectric strip are changed, and the gaps between the conductive planes in the cut-off regions on both sides of the dielectric strip thereby change. With this arrangement, a line transformation is obtained between the first and second non-radiative dielectric lines. As a result, the second line transition described in Japanese Unexamined Patent Application Publication No. 11-195910 is unnecessary. Thus, since no special region is required both in the width and length directions of the dielectric strip of the line transition, the overall structure can be made compact.

In addition, since the third non-radiative dielectric line (the line transition) is short in length, the non-radiative hybrid dielectric line transition can be simplified. Furthermore, the wave reflected at the boundary between the first and third non-radiative dielectric lines and the wave reflected at the boundary between the third and second non-radiative dielectric lines are effectively cancelled. As a result, a line transformation can be performed while maintaining low reflection and a low transmission loss.

According to the third aspect of the present invention, for example, the first non-radiative dielectric line is a hyper NRD waveguide and the second non-radiative dielectric line is a normal NRD waveguide. Thus, while exploiting the characteristics of these waveguides, an overall compact non-radiative dielectric line component having a low transmission loss can be formed.

In addition, since the coupling strength between the two non-radiative dielectric lines forming the directional coupler is increased, high dimensional accuracy is not needed in the regions where the two non-radiative dielectric lines are arranged. As a result, the directional coupler having a predetermined branching ratio can be easily obtained. Moreover, the "second line transition" described in Japanese Unexamined Patent Application Publication No. 11-195910 is unnecessary. Thus, since no special region is needed in the width direction of the dielectric strip of the line transition, the gaps between the two non-radiative dielectric lines forming the directional coupler can be easily narrowed. With this arrangement, a high coupling strength between the two lines can be obtained. Therefore, since the line lengths of the coupling parts can be made shorter, the overall component can be miniaturized.

According to the fourth aspect of the present invention, with the relative displacement of the mobile section with respect to the fixed section, while maintaining coupling between the fixed-section circuit and the primary radiator via the directional coupler, the directivity of a beam can be displaced. Moreover, since the directional coupler can be made compact and the weight of the mobile section can be reduced, the displacement unit can be miniaturized. As a result, high-speed beam scanning can be easily performed by the high-speed displacement of the mobile section.

According to the fifth aspect of the present invention, for example, there can be provided a compact millimeter-wave communication apparatus or a compact millimeter-wave radar having the non-radiative dielectric line component or the antenna apparatus described above.

Although the present invention has been described in relation to particular embodiments thereof, many other variations and modifications and other uses will become apparent to those skilled in the art. Therefore, the present invention is not limited by the specific disclosure herein.

What is claimed is:

1. A non-radiative hybrid dielectric line transition, comprising:

two conductive plates forming conductive planes opposed to each other approximately in parallel;

first grooves formed in opposing positions in the two conductive plates;

a first non-radiative dielectric line formed by a dielectric strip disposed between the first opposing grooves;

a second non-radiative dielectric line formed by a dielectric strip disposed between the two opposing conductive plates;

second grooves formed between the first non-radiative dielectric line and the second non-radiative dielectric line, the depths of the second grooves becoming gradually more shallow while continuing from the first grooves; and a third non-radiative dielectric line formed by a dielectric strip disposed in the second grooves to form a non-radiative hybrid dielectric line transition connecting the first non-radiative dielectric line and the second non-radiative dielectric line.

2. A non-radiative hybrid dielectric line transition, comprising:

two conductive plates forming conductive planes opposed to each other approximately in parallel;

first grooves formed in opposing positions in the two conductive plates;

a first non-radiative dielectric line formed by a dielectric strip disposed between the first opposing grooves;

a second non-radiative dielectric line formed by a dielectric strip disposed between the two opposing conductive plates;

second grooves formed between the first non-radiative dielectric line and the second non-radiative dielectric line, the depths of the second grooves becoming shallower step-by-step while continuing from the first grooves; and a third non-radiative dielectric line formed by a dielectric strip disposed in the second grooves to form a non-radiative hybrid dielectric line transition connecting the first non-radiative dielectric line and the second non-radiative dielectric line.

3. A non-radiative hybrid dielectric line transition according to claim 2, wherein the grooves of said grooves in the third non-radiative dielectric line have fixed lengths, and the length of said grooves in an electromagnetic-wave propagating direction is set to be approximately ¼ of a line wavelength.

4. A non-radiative dielectric line component comprising the first non-radiative dielectric line, the second non-radiative dielectric line, and the non-radiative hybrid dielectric line transition according to one of claims 1, 2, and 3.

5. A non-radiative dielectric line component according to claim 4, further comprising an additional non-radiative dielectric line component having first, second and third non-radiative dielectric lines, said additional non-radiative dielectric line component being arranged at a predetermined distance from said first-mentioned non-radiative dielectric line component to form a directional coupler.

6. A non-radiative dielectric line component according to claim 5, wherein said second non-radiative dielectric lines are spaced apart by a smaller distance than said first non-radiative dielectric lines.

7. A non-radiative dielectric line component according to claim 5, further comprising a circuit connected to said directional coupler and operable for processing at least one of a transmission signal and a reception signal conducted via said directional coupler.

8. An communication apparatus comprising:

a non-radiative hybrid dielectric line transition, comprising:

two conductive plates forming conductive planes opposed to each other approximately in parallel;

first grooves formed in opposing positions in the two conductive plates;

a first non-radiative dielectric line formed by a dielectric strip disposed between the first opposing grooves;

a second non-radiative dielectric line formed by a dielectric strip disposed between the two opposing conductive plates;

second grooves formed between the first non-radiative dielectric line and the second non-radiative dielectric line, the depths of the second grooves becoming gradually more shallow while continuing from the first grooves; and a third non-radiative dielectric line formed by a dielectric strip disposed in the second grooves to form a non-radiative hybrid dielectric line transition connecting the first non-radiative dielectric line and the second non-radiative dielectric line;

further comprising an additional non-radiative dielectric line component having first, second and third non-radiative dielectric lines, said additional non-radiative dielectric line component being arranged at a predetermined distance from said first-mentioned non-radiative dielectric line component to form a directional coupler;

said directional coupler having a mobile section with the first-mentioned non-radiative dielectric line component and a fixed section with the additional non-radiative dielectric line component extending in an electromagnetic-wave propagating direction at a location where said second non-radiative dielectric lines forming the directional coupler couple to each other;

a fixed dielectric lens; and a primary radiator disposed in the mobile section to radiate a signal transmitted via the directional coupler to the dielectric lens and send a signal received from the dielectric lens to the directional coupler.

9. A communication apparatus according to claim 8, further comprising a circuit connected to said directional coupler and operable for processing at least one of said signal received from the dielectric lens and said signal to be transmitted to the dielectric lens.

* * * * *